United States Patent [19]

Card et al.

[11] Patent Number: 4,691,646

[45] Date of Patent: Sep. 8, 1987

[54] KNIFE HOLDER FOR TUFTING MACHINE

[75] Inventors: Joseph L. Card; Roy T. Card, both of Chattanooga, Tenn.

[73] Assignee: Card-Monroe Corporation, Chattanooga, Tenn.

[21] Appl. No.: 508,853

[22] Filed: Jun. 29, 1983

[51] Int. Cl.[4] ..... D05C 15/24

[52] U.S. Cl. ..... 112/80.6

[58] Field of Search ..... 112/79 A, 79 R, 79 FF, 112/266.2, 410, 411; 83/700

[56] References Cited

U.S. PATENT DOCUMENTS

| | | | |
|---|---|---|---|
| 3,604,379 | 9/1971 | Cobble | 112/79 R |
| 3,757,709 | 9/1973 | Cobble | 112/79 R |
| 4,069,776 | 1/1978 | Cobble | 112/79 R |
| 4,193,360 | 3/1980 | Lund | 112/79 R |
| 4,269,126 | 5/1981 | Woodcock | 112/79 R |
| 4,445,446 | 5/1984 | Beasley | 112/79 R |

FOREIGN PATENT DOCUMENTS

| | | | |
|---|---|---|---|
| 2856343 | 7/1979 | Fed. Rep. of Germany | 112/79 R |
| 2808137 | 8/1979 | Fed. Rep. of Germany | 112/79 R |

*Primary Examiner*—H. Hampton Hunter

*Attorney, Agent, or Firm*—Newton, Hopkins & Ormsby

[57] ABSTRACT

A cut pile tufting machine having a knife holder assembly. The knife holder assembly includes a knife bar bracket carrying a vertically adjustable knife bar slotted along its side. A tongue of an upstanding knife holder bracket is clamped in the slot and a knife holder is carried by the upstanding bracket. Spaced parallel slots, angled from the plane of the knife holder and angled from the plane of the loopers, carry knives which cut the loops of the yarn on the loopers.

12 Claims, 6 Drawing Figures

KNIFE HOLDER FOR TUFTING MACHINE

BACKGROUND OF THE INVENTION

1. Field of the Invention

This invention relates to a cut pile tufting machine and is more particularly concerned with a knife holder assembly for a cut pile tufting machine.

2. Background of the Invention

In the past, cut pile tufting machines have been extensively used for producing fabric, having tufts which are cut at their outer extremities. Such prior art machines usually contain knives in groups of four which are carried by knife blocks. These knife blocks are mounted in succession on a knife bar bracket which is rocked back and forth by a knife drive shaft. Each knife block consists of inner and outer portions within which are formed opposed pairs of channel-shaped slots, the slots receiving the edges of knife blades so as to mount the knives in space parallel relationship. Set screws lock the knives in place. The inner and outer portions of the knife block are joined by a central web, which can be bent, in the event that the set screws on one side of the web are tightened to a greater extent than the set screws on the other side of the web. The inner portion of the knife block is provided with a stub shaft which protudes outwardly therefrom so as to be received in a cylindrical hole in the bracket, there being provided a set screw which locks the cylindrical mounting shaft in place. When this set screw becomes loose or the mounting shaft becomes scored, there is a tendency of the knife block to rotate and thereby loosen the tension which is applied by the upper edge portion of the knives against their respective loopers. This may cause the loops of yarn sewn by the tufting machine to hang up on the loopers.

SUMMARY OF THE INVENTION

Briefly described, the present invention includes a knife block assembly which is substituted for the conventional knife block and its supporting bracket. Specifically, the knife block or holder assembly of the present invention includes the conventional knife bar bracket which carries a backup bar fixed in place on the knife bar bracket so that it is rocked back and forth as the knife drive shaft is rocked back and forth. Mounted on the front face of the backup bar is a knife bar, the height of which can be vertically adjusted as desired. The knife bar has a transversely extending outwardly opening slot disposed therein. The slot receives the tongue or flange of an upstanding bracket on which is mounted a knife holder. The knife holder, in cross-section is a hollow, square or rectangular tubular member provided at its upper and lower edges with parallel slots. These parallel slots carry the knives in spaced parallel relationship so that they are angled upwardly and protrude between their respective loopers. Clamps, held by set screws, clamp the knives in place on the knife holder. A plurality of such knife holders extends transversely across the machine, being positioned side-by-side. Each knife is thus held parallel to its next adjacent knife and extends upwardly so that each knife blade is arranged at a compound angle inclined at an angle of about 82° from the horizontal and at about 4° from the plane of its associated looper. Thus, the cutting edge portion of each knife is yieldably urged into engagement with the cutting edge of the looper.

Accordingly, it is an object of the present invention to provide a knife holder assembly for a cut pile tufting machine which will hold the blades or knives at preset angles which do not vary.

Another object of the present invention is to provide a knife holder assembly for a cut pile tufting machine which will assure that a preset tension is applied to each of the knives or blades of the holder assembly.

Another object of the present invention is to provide a knife holder assembly for a cut pile tufting machine which is inexpensive to manufacture, durable in structure and efficient in operation.

Another object of the present invention is to provide a knife holder assembly for a cut pile tufting machine which requires no manual setting of the angle of the blades or knives and in which all knives or blades wear substantially uniformly across the machine.

Another object of the present invention is to provide a knife block assembly which is capable of holding a larger number of blades or knives than the prior art knife block.

Another object of the present invention is to provide a knife block assembly which does not warp when tension is applied to the set screws which lock the blades or knives in place in the assembly.

Another object of the present invention is to provide a knife block assembly for cut pile tufting machine which will support each blade or knife therein on all four sides of the blade or knife.

Another object of the present invention is to provide a knife block assembly which has webs between each of the blades or knives so as to space the blades positively and so as to give support to each blade and prevent pivoting of the outer portion of the block when the set screw is tightened or pressure is put on the knife.

Another object of the present invention is to provide a knife block assembly which will hold the blades or knives more uniformly.

Another object of the present invention is to provide a knife block assembly which will hold the blades or knives at an optimum compound angle with respect to the planes of their respective loopers.

Other objects, features and advantages of the present invention will become apparent from the following description when taken in conjunction with the accompanying drawing where in like characters of reference designate corresponding parts throughout the several views.

DESCRIPTION OF THE PREFERRED EMBODIMENT

Figure 1:
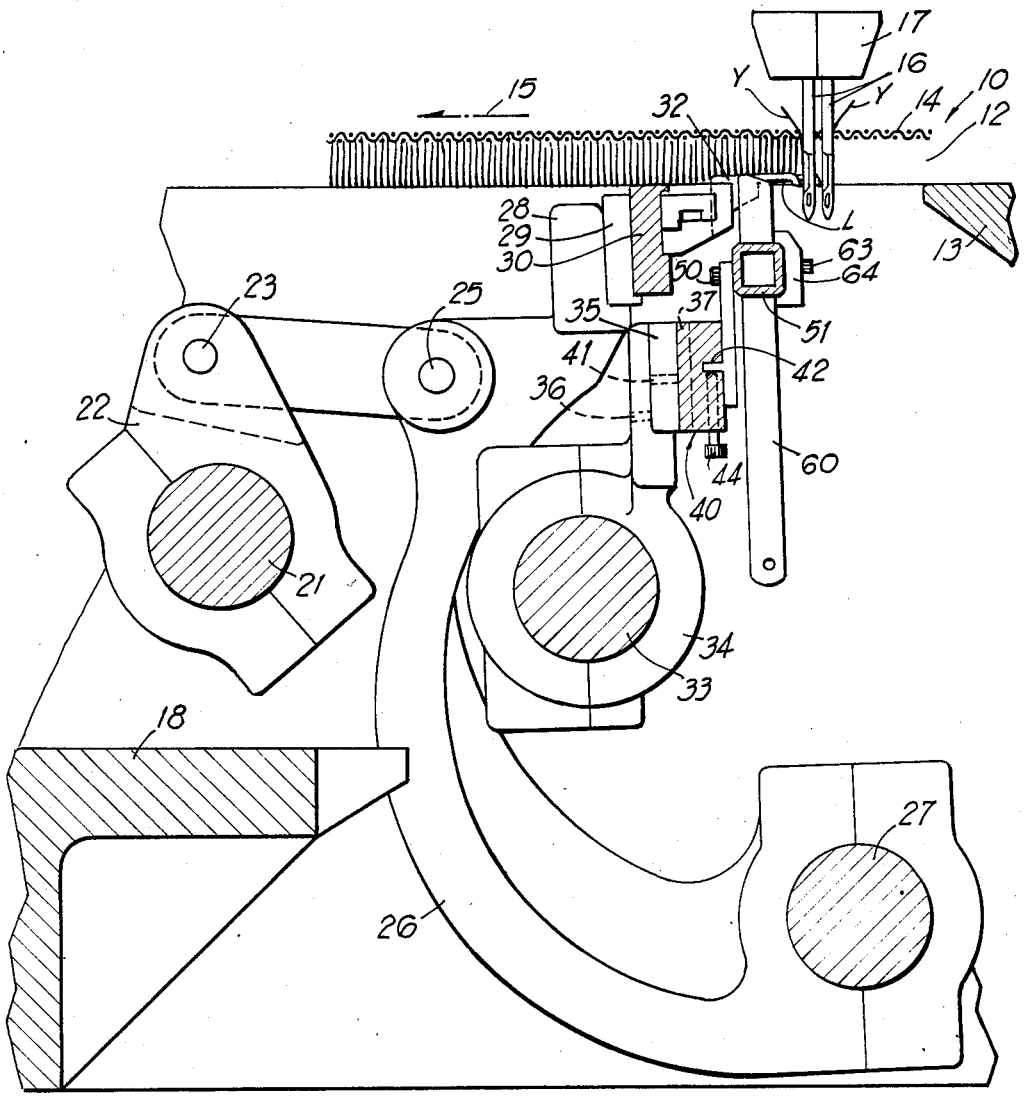
FIG. 1 is a vertical sectional view of a conventional cut pile tufting machine having provided thereon a knife holder assembly constructed in accordance with the present invention.

Referring now in detail to the embodiments chosen for the purpose of illustrating the present invention, numeral 10 in FIG. 1 denotes generally a cut pile tufting machine which has a frame 11 provided with a fabric bed 12 supported by a platform 13. Backing material 14 is fed in a longitudinal linear path across the tufting machine 10, the backing material 14 passing along the bed 12 and thence beneath reciprocating needles 16 carried by a reciprocating needle bar 17. The conventional tufting machine also includes a cross bar 18 between the ends of the frame 11.

Carried by the frame 11 is a transversely extending looper drive shaft 21 which carries a plurality of spaced levers, such as lever 22, which are respectively pivotally connected to links, such as line 24, by means of pivot pins, such as pivot pin 23. The links, such as link 24, extend longitudinally of the backing mataerial 14 and are connected through pivot pin, such as pivot pin 25, to a plurality of hook bar brackets, such as bracket 26, carried on a common pivot shaft 27. The upper end portion of the hood bars, such as hook bar 26, support mounting blocks 28 which, through back-up blocks 29 carry the looper supporting blocks 30. A plurality of cut pile loopers or looper hooks 32 are carried in side-by-side parallel relationship to each other and these cut pile loopers 32 are staggered and evenly spaced transversely across the path of travel of the backing material 14 so as to engage respectively the loops carried by the needles 16, when the needles 16 have inserted them through the backing material to about maximum depth.

The conventional tufting machine also includes a knife drive shaft 33 which carries a plurality of upstanding knife bar brackets, such as bracket 34. The brackets 34, in turn, carry transversely extending knife assembly supporting bars, such as bar 35. The successive assembly supporting bars 35 extending transversely across the machine and are held in place by set screws, such as set screw 36. The front face of each bar 35 is provided with T-shaped slots 37 which receive T-shaped rearwardly extending flanges of the knife bar, such as knife bar 40. Set screws 41 lock the T-shaped flanges in place. By loosening of the set screws 41, the height of each knife bar 40 can be varied, as desired.

Each knife bar 40 is provided with a non-circular recess, namely a horizontally extending channel-shaped, flange receiving recess or slot 42 which extends the entire length of the bar 40. Slot 42 opens forwardly or sidewise and is disposed approximately midway between the upper and lower edges of the bar 40. Each knife bar 40 is provided with a plurality of transversely spaced, vertically disposed, internally threaded bores, such as bore 43. Each bore 43 receives a detent means, namely a knife holder set screw, such as set screw 44. The front face 45 of the knife bar or block 40 is generally vertically disposed and essentially flat or planar and receives the flat rear surface 46 of a knife holder support bracket 47 of a knife holder means.

The support bracket 47 is an integrally formed member having a rearwardly protruding non-circular i.e. rectangular tongue or flange 48 which has planar dimensions so that it snugly fits into the slot 42 and so that the bracket 47 is firmly held in place, when the set screws 44 are tightened. Since the flange or tongue 48 has spaced increments which are confined within the slot 42, any appreciable rotational movement of the bracket 47 is arrested by bar 40. The bracket 47 has a flat rectangular body with the tongue or flange 48 extending transversely along an intermediate portion thereof, protruding perpendicularly away from the rear surface 46. Thus, a portion of the bracket 47 extends below the tongue or flange 48 and is received flat against the face 45 of bar 40, below the slot 42. The tongue 48 extends transversely throughout the width of bracket 47 and when clamped in place, it firmly fixes the bracket 47 so that its rear surface 46 is contiguous with the surface 45 and, thus, the bracket 47 does not tend to bend to any appreciable extent.

The upper end portion of the bracket 47 extends above bar 40 and is provided with holes through which bolts 50 project, the bolts 50 being threadedly received in a knife holder means, including a hollow, square or rectangular knife holder 51. The knife holder 51 extends forwardly of the bracket 47 and transversely across the upper portion of the flat front surface 52 of the bracket 47 so that the upstanding rear plate 53 of the knife holder 51 is held flat against the upper surface portion of the bracket 47.

The knife holder 51 of the knife holder means, being a hollow, tubular, rectangular member, has an upper plate 54 and a lower plate 55 in spaced generally horizontal parallel relationship and these plates 54 and 55 protrude from the upper and lower edges respectively of the back plate 53. The outer end portions of the upper and lower plates 54 and 55 are joined by front plate 56 which is disposed parallel to and spaced from back plate 53. The inside width of the knife holder 51 from the front surface of plate 53 to the rear surface of plate 56 is approximately equal to or slightly wider than the width of a knife or blade 60.

Figure 2:
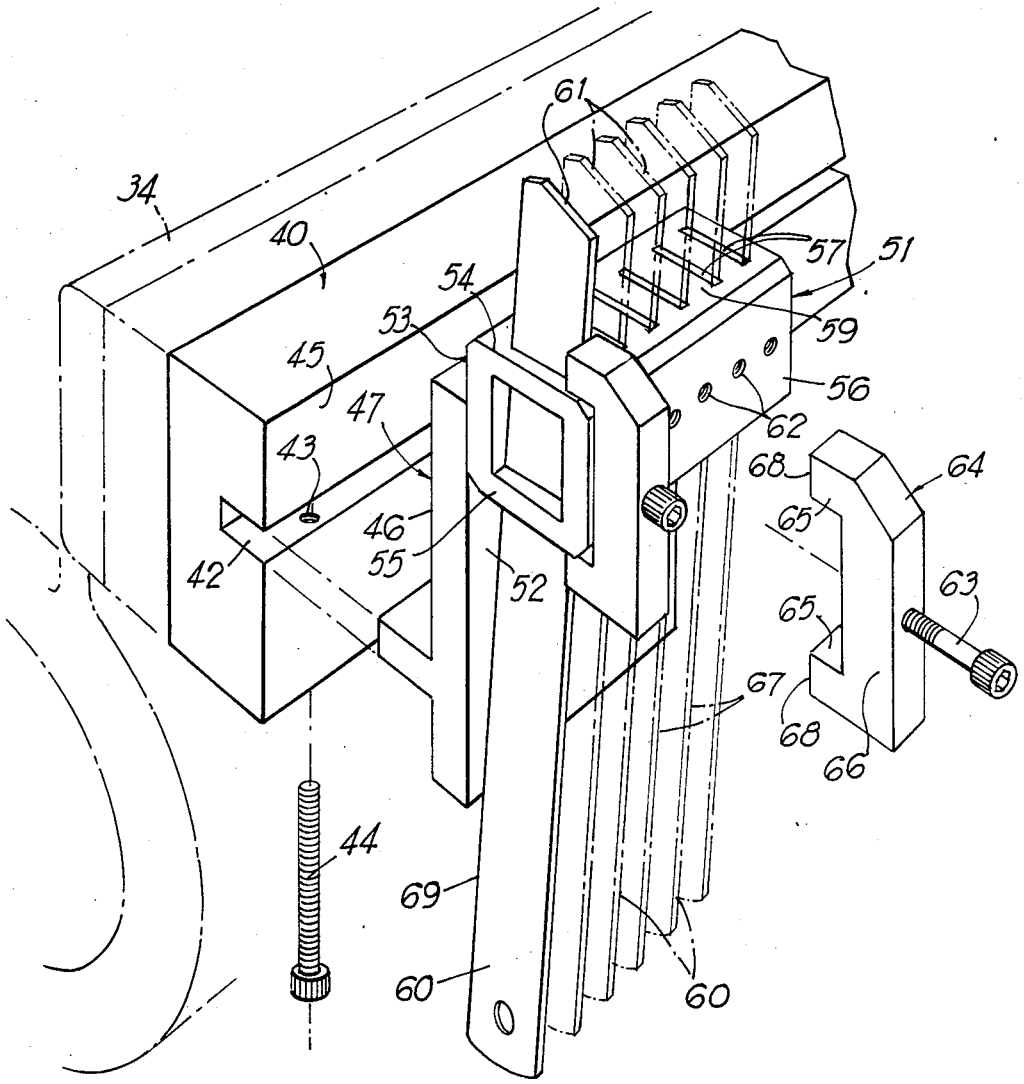
FIG. 2 is an enlarged exploded perspective view of a portion of the knife holder assembly depicted in FIG. 1.
Figure 3:
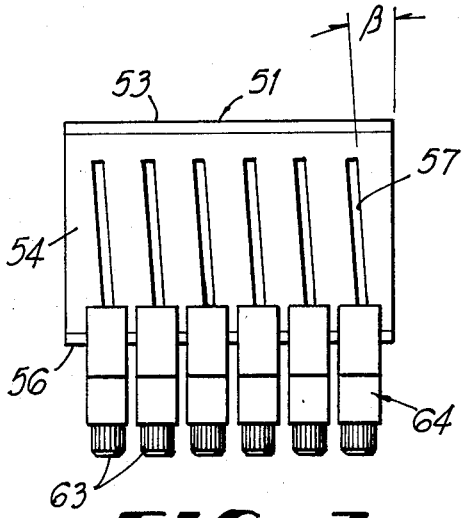
FIG. 3 is an enlarged top plan view of the knife holder of the knife holder assembly depicted in FIG. 1.
Figure 4:
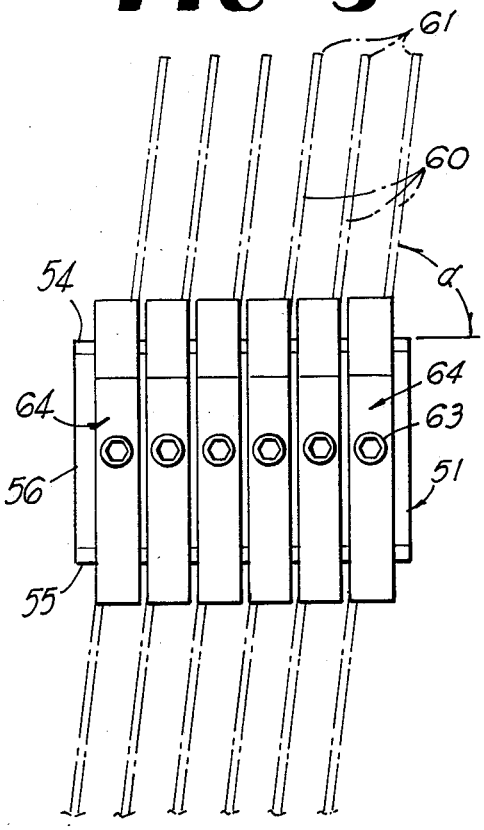
FIG. 4 is a front elevational view of the knife holder depicted in FIG. 3.
Figure 5:
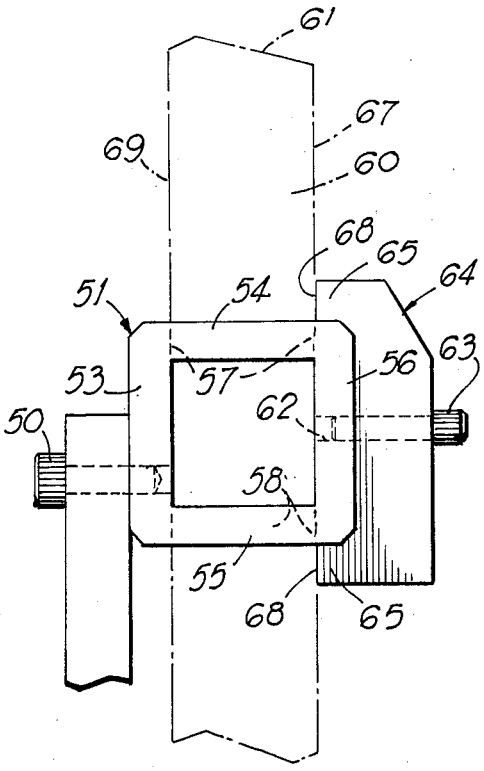
FIG. 5 is a side elevational view of the knife holder depicted in FIGS. 3 and 4.

As best seen FIGS. 2 and 3, the upper plate 54 of the bracket holder 51 is provided with a plurality of evenly spaced parallel angling closed blade receiving slots 57. Each slot 57 is arranged at a compound angle in that the slot, as viewed in elevation as in FIG. 4 is arranged at an acute angle $\alpha$ to the horizontal or plane of the plate 54, the angle $\alpha$ being from about 78° to about 86° and preferably approximately 82°. When viewed in plan view as seen in FIG. 3, each slot 57 is arranged at an acute angle $\alpha$ of from about 5° to about 11° and preferably approximately 8° from the longitudinal along the path of travel of the fabric or backing material 14 or plane of their loospers 32. Each slot 57 has an opening which is only slightly larger than the dimensions of the blade or knife 60 which it receives. Thus, when the blade of knife 60 is inserted through the slot, an increment of the blade 60 is firmly held being confined against appreciable movement longitudinally and transversely by the block 51. The webs 59 between the slots 57 evenly space the knives or bladss 60 apart.

The lower slots, such as slot 58, are offset from their cooperating slots 57 and are milled out parallel to each other at compound angles so as that the inner surfaces defining the lower slots, such as slot 58, are aligned with the inner surfaces defining the cooperating upper slots 57. Thus, a blade 60 passing through an upper slot 57 will be guided by the this upper slot 57 into a slot 58, which is offset laterally of the aligned slot 57. In such an arrangement, each blade 60 passes through an upper slot 57 and a lower slot 58 so that a lower increment of the blade is confined by the plate 55. The webs between slots 58 evenly space the knives 60 apart.

The central portion of the front plate 56 is provided with a plurality of equally spaced holes 62 which are arranged in a horizontal row therealong. Each hole 62 is internally threaded and receives a knife set screw 63, therein. Each knife set screw 63 passes through the central portion of a detent means such as a C-shaped knife clamp 64, the knife clamp 64, having inwardly protruding fingers 65 connected at opposite ends of a web 66. The fingers 65 extending over the upper plate 54 and below the lower plate 55 for engaging a single blade 60 along its outer or front edge 67. By such an arrangement, when the set screw 63 is tightened, the inner flat surfaces 68 of the fingers 65 engage this edge 67 above and below the plates 54 and 55, respectively. Upon further tightening of the set screw 63, the rear edge portion 69 of blade 60 is urged against the inner surface of the plate 53.

The slots 57 and 58 are arranged in equally spaced alignment so as to receive and hold a plurality of equally spaced blades or knives 60, each knife 60 being readily and easily adjusted according to height by simply loosening the set screw 63 associated with that knife 60 so as to permit manual movement of that knife 60. Upon tightening of the screw 63 associated with the knife or blade 60, the blade 60 will again be held firmly in place at a prescribed height.

While I have illustrated only six (6) blades 60 being carried by a holder 51, it is preferable to provide approximately ten (10) knives for each individual holder 51. Because of the flange or tongue 48 which is firmly held in slot 42, there is essentially no tendency of the knife holder 51 to rotate so as to relax the pressure applied by the knife 60 against the side of the looper 32. By arranging the knife holders, such as holder 51, in juxtaposition across the length of the back-up bars 35, the knives 60 can be quite readily and easily positioned appropriately so that each knife 60 operates with its associated looper 32. Both the knives or blades 60 and the bracket 40 can be quite readily removed from the assembly, either an individual knife 60 or a set of knives 60 carried by bracket 47 and can be quite easily replaced. The action of the knives 60 against the side surfaces of the loopers 32 will cut the loops L caught by the loopers 32, after needles 16 have inserted the yarn Y through the backing material 14. Thus, longitudinal rows of cut pile 17 are produced.

Figure 6:
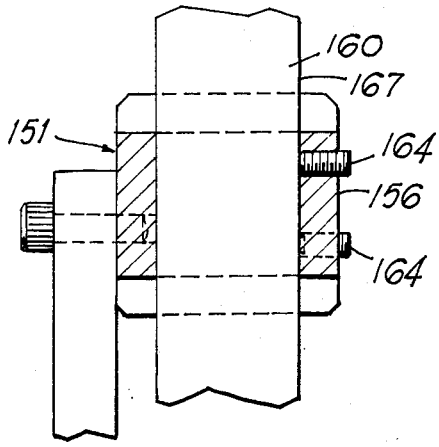
FIG. 6 is a view of a detail showing a modified form of the present invention.

In FIG. 6 is illustrated an alternate embodiment of the invention, in which the clamp 64 and the set screw 63 for each blade 60 is replaced. In FIG. 6, the knife holder 151 which carries the knives, such as knife 160. Here, in place of the clamp 64 and its set screw 63, a set screws 164 which has external threads pass through and are threadedly respectively received in staggered holes, so as to engage the leading edges 167 of knives 160 and thereby arrest each knife or blade 160. It is preferable to stagger the alternate set screws 164, as shown in FIG. 6, whereby two rows of set screws 164 are provided, the upper row of screws 164 engaging every other blade 160 and the lower row of screws 164 engaging the remaining knives or blades 160.

It will be obvious to those skilled in the art that many variations may be made in the embodiment here chosen for the purpose illustrating the present invention without departing from the scope thereof as defined by the appended claims.

We claim:

1. A tufting machine of the type having needles for inserting yarns through a backing material and wherein a plurality of laterally spaced loopers catch and hold the loops of yarns as they are inserted through backing material by the needles, and a knife assembly supporting means is reciprocated for moving knives for cutting action with respect to the loops caught by the loopers; wherein the improvement comprises: a knife assembly between said knives and said knife assembly support means, said knife assembly including a laterally extending knife bar carried by said supporting means, said knife bar having a sidewise opening laterally extending recess in one side thereof, a plurality of side-by-side knife holder means disposed on said one side of said knife bar, each of said knife holder means having a bracket element and a laterally extending tongue fixed to and protruding sidewise from said bracket element into said recess, said tongue being sufficiently long that when it is received in said recess it prevents appropriable relative rotational movement of said knife holder means with respect to said knife bar, each of said knife holder means being movable into and out of its position adjacent to one side of said knife bar, and detent means for removably locking said tongue in place in said recess, said bracket element being disposed in a generally horizontal plane and having a plurality of equally spaced parallel slots, said slots being disposed at an acute angle to the horizontal plane of said bracket element and respectively receiving said knives therein for holding said knives with their cutting edges against and cooperating with said loopers.

2. The tufting machine defined in claim 1 wherein said bracket element includes a hollow tubular transversely extending knife holder, having an upper plate and a lower plate and wherein said slots are provided in both said upper plate and said lower plate.

3. The tufting machine defined in claim 2 including a c-shaped knife clamp disposed outwardly of said knife holder and engaging said knives above and below said knife holder.

4. The tufting machine defined in claim 3 including a set screw passing through the central portion of said c-shaped clamp and threadedly received in said knife holder, said set screw being tightenable for urging the knives against said knife holder.

5. The tufting machine defined in claim 1 wherein said recess is a channel-shaped outwardly opening slot along said knife bar and wherein said tongue is a flange received within and conforming generally to the shape of the slot forming said recess.

6. The tufting machine defined in claim 1 wherein said knife bar defines a flat upright surface, said recess being an outwardly opening slot opening through said surface and said bracket element including a flat body portion flush against said flat surface of said knife bar, said tongue being a rectangular flange received within said outwardly opening slot.

7. The tufting machine defined in claim 6 wherein said bracket element includes a bracket carried by said knife bar and a hollow tubular rectangular knife holder including a back plate, an upper plate, a lower plate and a front plate, said knife holder being secured by its back plate to said bracket, said slots being provided in said upper plate and in said lower plate, the slots of said upper plate being offset laterally from the slots of the lower plate, each of said knives passing through a slot in said upper plate and a slot in said lower plate.

8. The tufting machine defined in claim 1 wherein said knife bar has a flat generally upright surface along said one side thereof, and said bracket element has a flat side, said tongue protruding from an intermediate portion of said flat side, said tongue conforming to the shape and dimension of said recess sufficiently that when said tongue is received in said recess, flat surface of said bracket is contiguous with the flat surface of said knife bar above and below said tongue.

9. The tufting machine defined in claim 1 wherein said bracket element includes a bracket with said tongue extending from a first side thereof, said bracket having a second side opposite to said first side, said portion of said bracket element including a knife holder on said second side offset upwardly from said tongue and protruding away from said second sides, said knife holder including said slots which receive said knives, said plates hold ing said knives with their edges outwardly adjacent and parallel to said second side.

10. The tufting machine defined in claim 1 wherein said detent means includes a set screw threadedly received in the bottom portion of said knife bar, said set screw protruding into said recess and engaging said tongue when said set screw is tightened.

11. The tufting machine defined in claim 1 wherein said bracket element includes vertically spaced upper and lower plates protruding from the upper end portion of said bracket element and away from said knife bar, said plates being provided with said slots so that each knife is received in a slot in said upper plate and in a slot in said lower plate.

12. The tufting machine defined in claim 1 wherein said bracket element includes a bracket protruding beyond said knife bar upwardly toward said looper and includes a knife holder carried by the upper end portion provided with said slots, said knife holder holding said knives spaced from and outwardly adjacent to said bracket.

* * * * *